US008375922B2

(12) United States Patent
Cinpinski et al.

(10) Patent No.: US 8,375,922 B2
(45) **Date of Patent: *Feb. 19, 2013**

(54) CONTROL OF FUEL PUMP BY QUANTIFYING PERFORMANCE

(75) Inventors: Kenneth J. Cinpinski, Ray, MI (US); Byungho Lee, Ann Arbor, MI (US); Donovan L. Dibble, Utica, MI (US); Joseph R. Dulzo, Novi, MI (US); Scot A. Douglas, Canton, MI (US)

(73) Assignee: GM Global Technology Operations LLC

( * ) Notice: Subject to any disclaimer, the term of this patent is extended or adjusted under 35 U.S.C. 154(b) by 898 days.

This patent is subject to a terminal disclaimer.

(21) Appl. No.: 12/424,133

(22) Filed: Apr. 15, 2009

(65) Prior Publication Data

US 2010/0268439 A1 Oct. 21, 2010

(51) Int. Cl.
*F02M 37/04* (2006.01)

(52) U.S. Cl. ..... 123/446; 123/495

(58) Field of Classification Search ..... 123/446, 123/447, 457, 495, 514, 688; 701/103, 104, 701/107, 114; 73/114.41, 114.43, 114.45, 73/114.48, 114.51

See application file for complete search history.

(56) References Cited

U.S. PATENT DOCUMENTS

| | | | | |
|---|---|---|---|---|
| 5,445,019 | A * | 8/1995 | Glidewell et al. | 73/114.51 |
| 5,493,902 | A * | 2/1996 | Glidewell et al. | 73/114.43 |
| 6,971,368 | B2 * | 12/2005 | Uchiyama | 123/359 |
| 7,278,405 | B2 * | 10/2007 | Takahashi | 123/514 |
| 7,552,716 | B2 * | 6/2009 | Osaki | 123/457 |
| 7,698,931 | B2 * | 4/2010 | Hanari et al. | 73/114.43 |
| 7,835,850 | B2 * | 11/2010 | Nakata et al. | 701/104 |
| 7,950,371 | B2 * | 5/2011 | Cinpinski et al. | 123/446 |
| 7,980,120 | B2 * | 7/2011 | Cinpinski et al. | 73/114.43 |

* cited by examiner

*Primary Examiner* — John Kwon

(57) ABSTRACT

An engine control system comprises a fuel pump control module and a diagnostic module. The fuel pump control module controls a pressure pump to inject fuel into a fuel rail. The diagnostic module determines an estimated pressure increase within the fuel rail based on the injected fuel, compares an actual pressure increase within the fuel rail to the estimated pressure increase, and indicates when the actual pressure increase is less than the estimated pressure increase.

14 Claims, 5 Drawing Sheets

CONTROL OF FUEL PUMP BY QUANTIFYING PERFORMANCE

FIELD

The present disclosure relates to fuel injection systems and more particularly to systems and methods for improving high pressure fuel pump performance.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In an engine system, air is drawn into an engine. The air mixes with fuel to form an air-fuel mixture. Fuel is supplied to the engine by a fuel system. For example only, the fuel system may include the fuel injectors, a fuel tank, a low pressure pump, a high pressure pump, and a fuel rail. Fuel is stored within the fuel tank. The low pressure pump draws fuel from the fuel tank and provides fuel to the high pressure pump. The high pressure pump provides pressurized fuel to the fuel injectors via the fuel rail. The pressure of the fuel exiting the high pressure pump may be greater than the pressure of the fuel exiting the low pressure pump.

An engine control module (ECM) receives a rail pressure signal from a rail pressure sensor. The rail pressure signal indicates the pressure of the fuel within the fuel rail. The ECM controls the amount and the timing of the fuel injected by the fuel injectors. The ECM maintains the rail pressure via the high pressure pump.

SUMMARY

An engine control system comprises a fuel pump control module and a diagnostic module. The fuel pump control module controls a high pressure fuel pump to inject fuel into a fuel rail. The diagnostic module determines an estimated pressure increase within the fuel rail based on the injected fuel from the high pressure fuel pump, compares an actual pressure increase within the fuel rail to the estimated pressure increase, and indicates when the actual pressure increase is less than the estimated pressure increase. In further features, the diagnostic module compares the actual pressure increase to the estimated pressure increase when fuel injection out of the fuel rail is suspended. In other features, the diagnostic module controls the fuel pump control module to inject a predetermined amount of fuel when fuel injection out of the fuel rail is suspended.

In other features, the diagnostic module calculates a compensation factor based on the comparison. In other features, the diagnostic module indicates when the compensation factor is greater than or equal to a predetermined threshold. In further features, the engine control system further comprises a compensation module that generates a compensated pressure signal based on the compensation factor and a desired pressure, and the fuel pump control module controls the high pressure fuel pump to inject fuel based on the compensated pressure signal. In other features, the diagnostic module suspends calculating the compensation factor when the actual pressure increase is greater than or equal to the estimated pressure increase.

An engine control method comprises controlling a pressure pump to inject fuel into a fuel rail; determining an estimated pressure increase within the fuel rail based on the injected fuel; comparing an actual pressure increase within the fuel rail to the estimated pressure increase; and indicating when the actual pressure increase is less than the estimated pressure increase. In further features, the engine control method further comprises comparing the actual pressure increase to the estimated pressure increase when fuel injection out of the fuel rail is suspended. In other features, the engine control method further comprises controlling the fuel pump control module to inject a predetermined amount of fuel when fuel injection out of the fuel rail is suspended.

In other features, the engine control method further comprises calculating a compensation factor based on the comparison. In further features, the engine control method further comprises indicating when the compensation factor is greater than or equal to a predetermined threshold. In other features, the engine control method further comprises generating a compensated pressure signal based on the compensation factor and a desired pressure, and controlling the high pressure fuel pump to inject fuel based on the compensated pressure signal.

In other features, the engine control method further comprises suspending calculation of the compensation factor when the actual pressure increase is greater than or equal to the estimated pressure increase.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
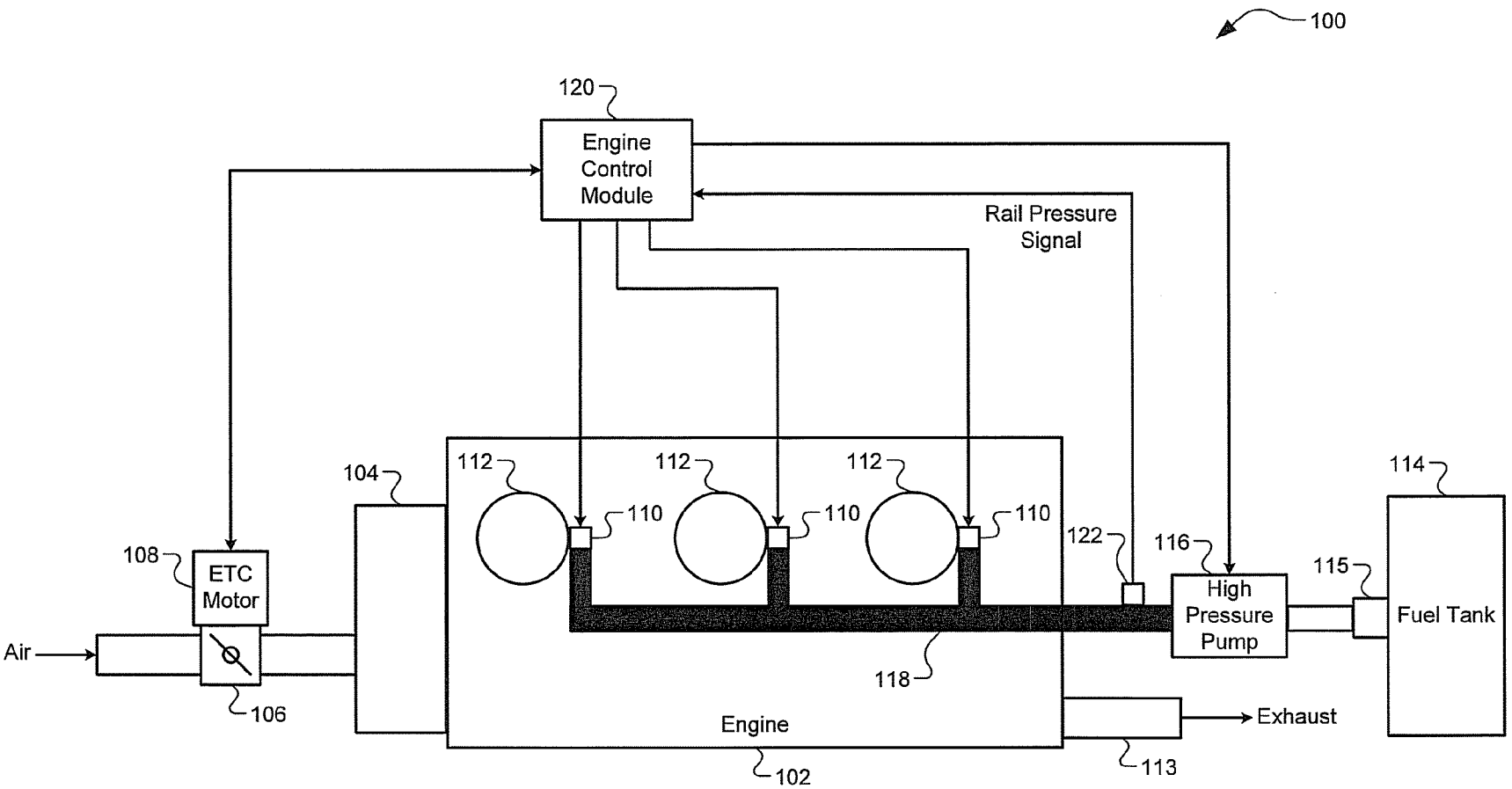
FIG. 1 is a functional block diagram of an engine system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

A high pressure pump injects pressurized fuel into a fuel rail to achieve a desired pressure within the fuel rail. Fuel injectors connected to the fuel rail inject fuel into cylinders. Over time, the high pressure pump may provide less fuel than is commanded. For example, the high pressure pump may deteriorate over time or mechanical problems, such as blockages, may occur. When less fuel is provided to the fuel rail than is expected, the amount of fuel injected into the cylinders may be lower than desired.

In order to measure performance of the high pressure pump, the fuel rail may be treated as a closed system. For example only, injection of fuel by the fuel injectors may be suspended. The pressure within the fuel rail may be measured and a desired pressure increase may be estimated. A compensation factor may be calculated by injecting a predetermined amount of fuel into the fuel rail and comparing the pressure increase to the estimated pressure increase. The compensation factor may be used to compensate for a deficiency of the high pressure pump.

Referring now to FIG. 1, a functional block diagram of an engine system 100 is shown. Air is drawn into an engine 102 through an intake manifold 104. A throttle valve 106 is actuated by an electronic throttle control (ETC) motor 108 to vary the volume of air drawn into the engine 102. The air mixes with fuel from one or more fuel injectors 110 to form an air-fuel mixture. The air-fuel mixture is combusted within one or more cylinders 112 of the engine 102. Resulting exhaust gas is expelled from the cylinders to an exhaust system 113.

Fuel is supplied to the engine 102 by a fuel system. For example only, the fuel system may include the fuel injectors 110, a fuel tank 114, a low pressure pump 115, a high pressure pump 116, and a fuel rail 118. Fuel is stored within the fuel tank 114. The low pressure pump 115 draws fuel from the fuel tank 114 and provides fuel to the high pressure pump 116. The high pressure pump 116 provides pressurized fuel to the fuel injectors 110 via the fuel rail 118. The pressure of the fuel exiting the high pressure pump 116 may be greater than the pressure of the fuel exiting the low pressure pump 115. For example only, the pressure of the fuel exiting the high pressure pump 116 may be between 2-26 Mpa, while the pressure of the fuel exiting the low pressure pump 115 may be between 0.3-0.6 Mpa.

An ECM 120 receives a rail pressure signal from a rail pressure sensor 122. The rail pressure signal indicates the pressure of the fuel within the fuel rail 118. The ECM 120 controls the amount and the timing of the fuel injected by the fuel injectors 110. The rail pressure decreases each time fuel is injected by one or more of the fuel injectors 110. The ECM 120 maintains the rail pressure via the high pressure pump 116.

Figure 2:
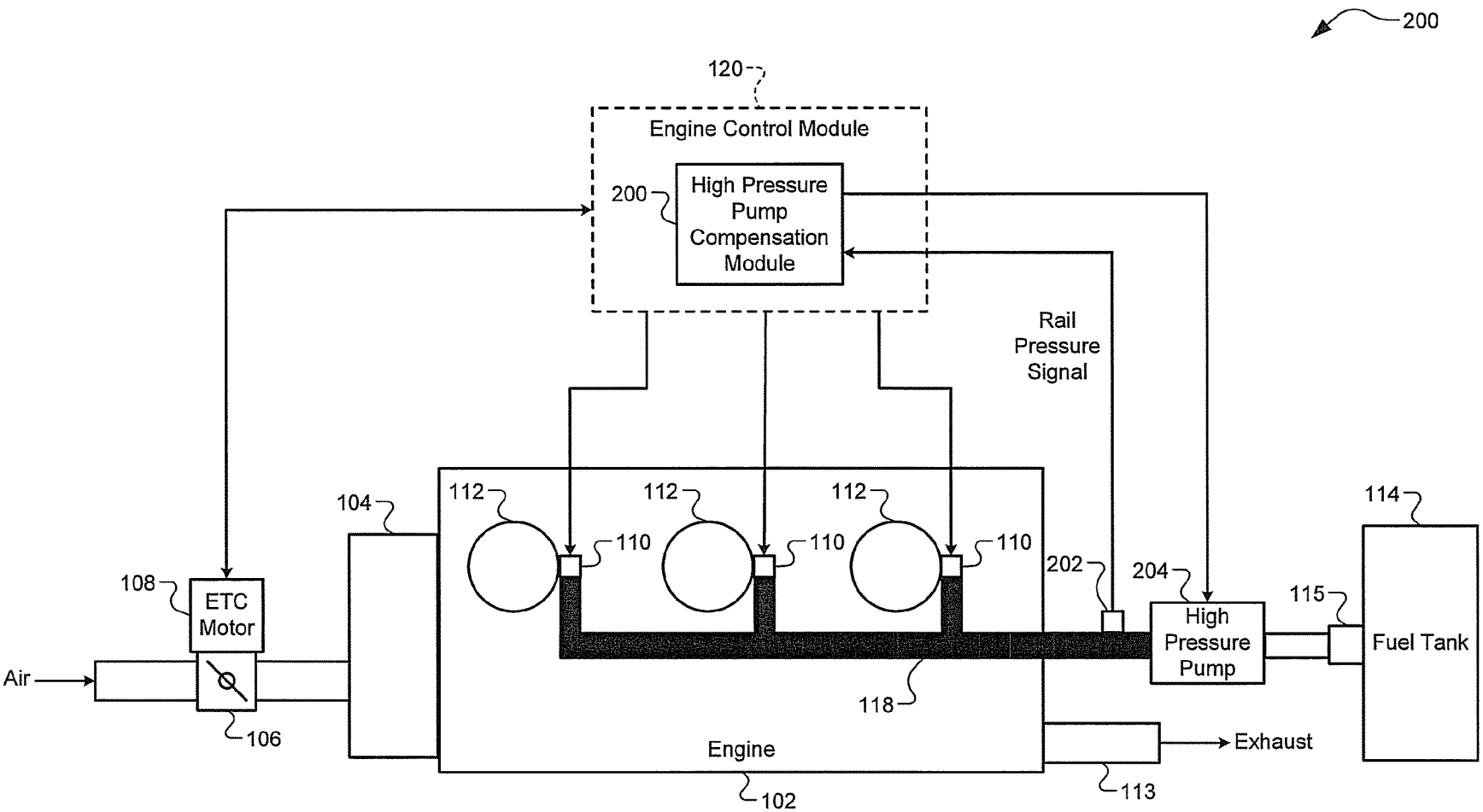
FIG. 2 is a functional block diagram of an exemplary engine system according to the principles of the present disclosure.

Referring now to FIG. 2, a functional block diagram of an exemplary engine system according to the principles of the present disclosure is shown. A high pressure pump compensation module (HPPCM) 200 receives a rail pressure signal from a rail pressure sensor 202. The rail pressure signal may be used as a measurement for a compensation factor when controlling a high pressure pump 204. The compensation factor may allow the HPPCM 200 to determine whether the high pressure pump 204 is deteriorating or not working properly. The compensation factor may be used by the HPPCM 200 to compensate or adjust for deficiencies of the high pressure pump 204.

Figure 3:
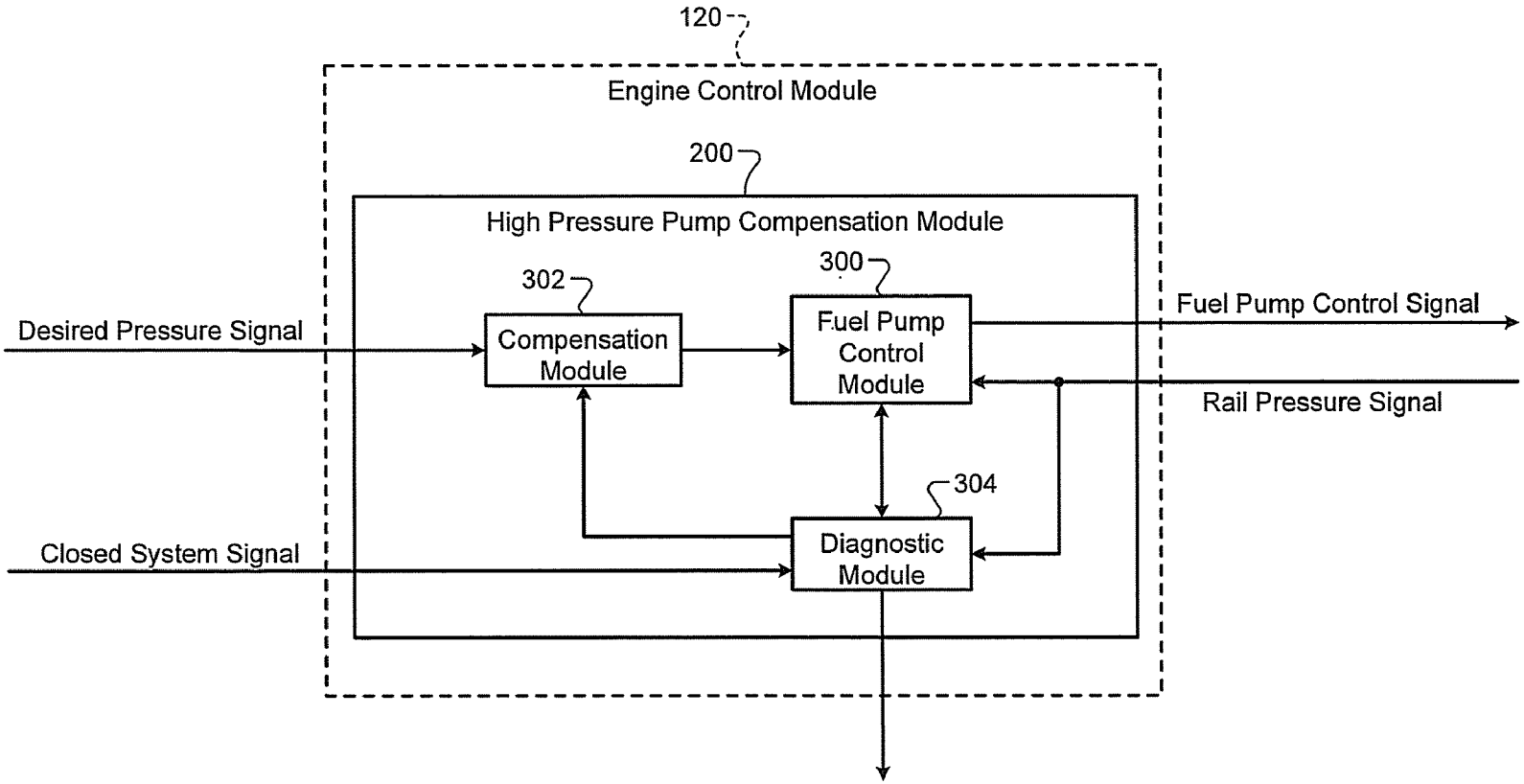
FIG. 3 is a functional block diagram of an exemplary implementation of the high pressure pump compensation module of FIG. 2 according to the principles of the present disclosure.

In FIG. 3, a functional block diagram of an exemplary implementation of the HPPCM of FIG. 2 according to the principles of the present disclosure is shown. A fuel pump control module 300 controls the high pressure pump 204 via a fuel pump control signal. The fuel pump control module 300 receives a compensated pressure signal from a compensation module 302 and controls the high pressure pump 204 based on the compensated pressure signal. The fuel pump control module 300 may receive the rail pressure signal to determine how often, and at what intensity, to control the high pressure pump 204.

A diagnostic module 304 receives the rail pressure signal. The diagnostic module 304 monitors the rail pressure during testing of the high pressure pump 204. When the diagnostic module 304 receives a start test signal, it determines whether the rail pressure is less than a predetermined threshold. If the rail pressure is less than the predetermined threshold, then testing of the high pressure pump 204 begins. The start test signal is generated when testing may begin. For example only, the test may begin when fuel is cutoff from the cylinders.

When testing of the high pressure pump 204 begins, the diagnostic module 304 transmits a pump test signal to the fuel pump control module 300. Upon receiving the pump test signal, the fuel pump control module 300 controls the high pressure pump 204 to inject a predetermined amount of fuel into the fuel rail. During this injection, the diagnostic module 304 monitors an actual rail pressure increase.

The diagnostic module 304 compares the actual rail pressure increase to an estimated rail pressure increase. The estimated rail pressure increase is an estimation of an expected rail pressure increase for injection of the predetermined amount of fuel. If the actual rail pressure increase is less than the estimated rail pressure increase, then the compensation factor may be calculated. If the actual rail pressure increase is greater than or equal to the estimated rail pressure increase, then calculation of the compensation factor may be disabled.

The compensation factor is determined based on a difference between the actual rail pressure increase and the estimated rail pressure increase. As discussed in more detail below, the compensation factor may be implemented to compensate for the difference. For example only, a lookup table or algorithm may be used to determine the compensation factor. The compensation factor is transmitted to the compensation module 302.

The compensation factor may be compared to a threshold. For example, compensation of the high pressure pump 204 may be insufficient or the high pressure pump 204 may need to be replaced when the compensation factor is greater than or equal to the threshold. If the calculated compensation factor is greater than or equal to the threshold, then the diagnostic module 304 may generate a fault code.

The compensation module 302 receives a desired pressure signal. The desired pressure signal indicates the desired rail pressure for the fuel rail. The fuel pump control module 300 controls the high pressure pump 204 so that the desired rail pressure is maintained. However, if the actual rail pressure increase is less than the estimated rail pressure increase, then the desired rail pressure may not be achieved when controlling the high pressure pump 204. The compensation module 302 uses the compensation factor to adjust the desired pressure signal to generate a compensated pressure signal.

The implementation of the compensation factor allows for a better realization of the desired rail pressure because the actual rail pressure increase may be closer to the estimated rail pressure increase. The compensation module 302 transmits the compensated pressure signal to the fuel pump control module 300. Then, the fuel pump control module 300 uses the compensated pressure signal to control the high pressure pump 204 to achieve the desired pressure within the fuel rail.

Figure 4:
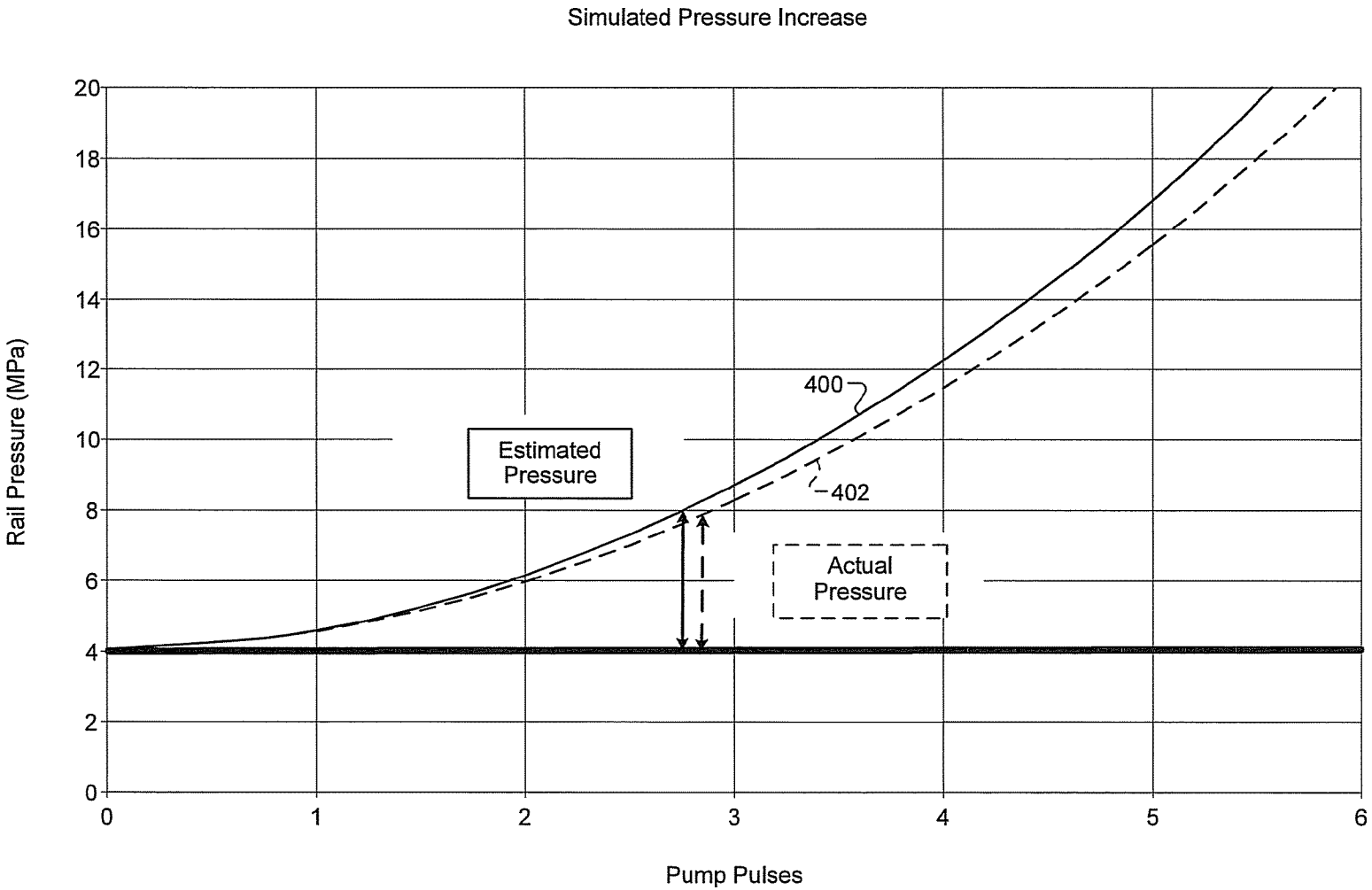
FIG. 4 is a graphical depiction of an exemplary method of determining a compensation factor according to the principles of the present disclosure.

In FIG. 4, a graphical depiction of an exemplary method of determining a compensation factor according to the principles of the present disclosure is shown. An estimated pressure increase 400 demonstrates rail pressure increase per pump pulse for the high pressure pump 204 based on exemplary predetermined values. An actual pressure increase 402 shows rail pressure increase per pump pulse for the high pressure pump 204 based on exemplary actual values. The difference between the two lines may be considered the compensation factor. In various implementations, the compensation factor may be determined by comparing the actual pressure increase 402 to a predetermined set of values using mappings, algorithms, or look-up tables.

Figure 5:
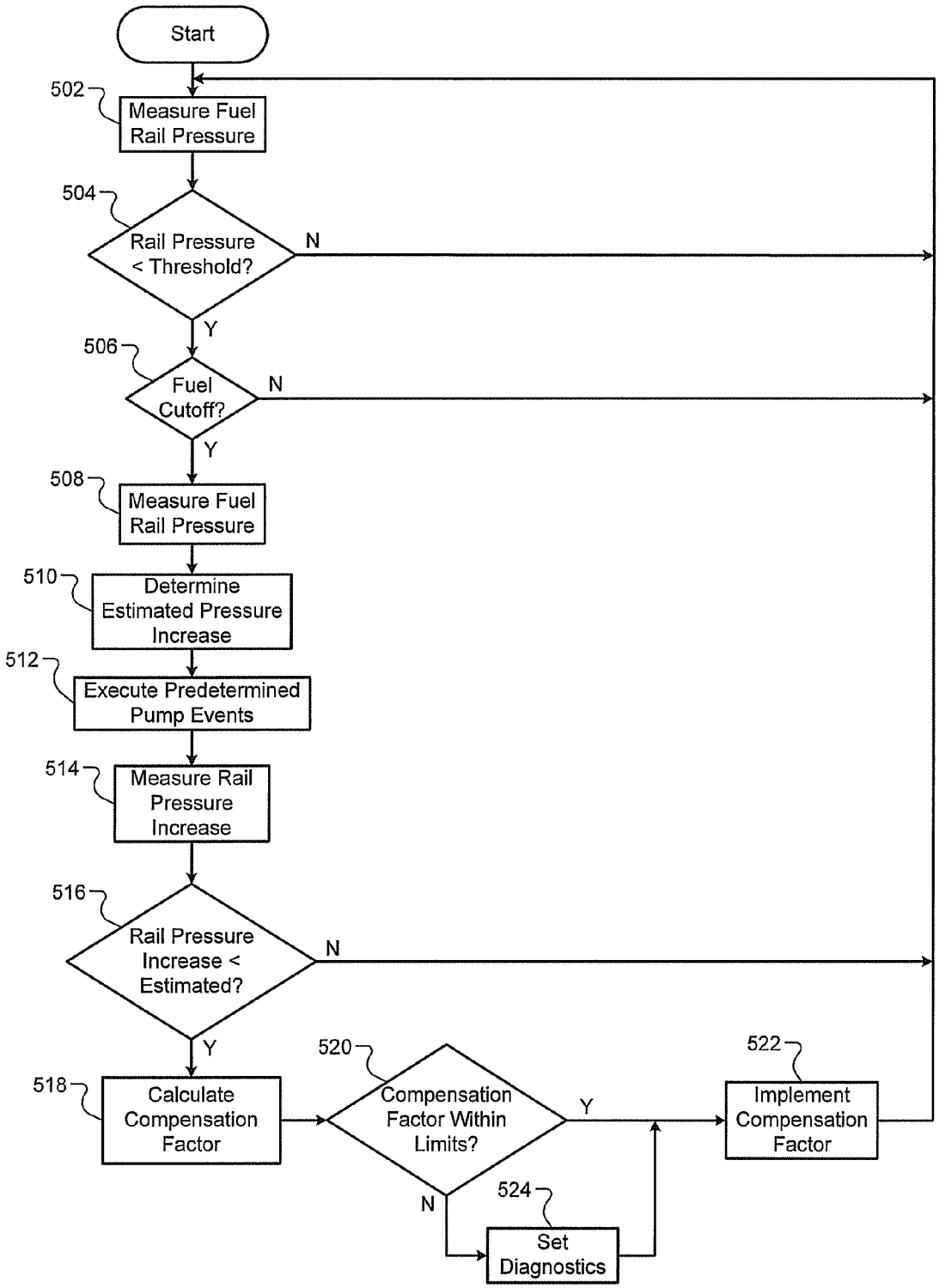
FIG. 5 is a flowchart that depicts exemplary steps performed in determining high pressure pump compensation according to the principles of the present disclosure.

In FIG. 5, a flowchart that depicts exemplary steps performed in determining high pressure pump compensation according to the principles of the present disclosure is shown. In step 502, control measures fuel rail pressure. In step 504, control compares the measured fuel rail pressure to a threshold. If the measured fuel rail pressure is greater than the threshold, then control returns to step 502; otherwise, control transfers to step 506.

In step 506, control waits for proper test conditions (i.e. fuel cutoff). If the proper test conditions are met, then control transfers to step 508; otherwise, control returns to step 502. In step 508, control measures fuel rail pressure. In step 510, control determines an estimated pressure increase. In step 512, control executes predetermined pump events. In step 514, control determines an increase in rail pressure.

In step 516, control compares the rail pressure increase to the estimated pressure increase. If the rail pressure increase is less than the estimated pressure increase, then control transfers to step 518; otherwise, control returns to step 502. In step 518, control calculates a compensation factor for the fuel pump. In step 520, control determines whether the compensation factor is within limits. If the compensation factor is not within the limits, then control transfers to step 524; otherwise, control transfers to step 522. In step 524, control sets diagnostics. In step 522, the compensation factor is used in the system. Control returns to step 502.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. An engine control system comprising:

a fuel pump control module that controls a pump to inject fuel into a fuel rail; and a diagnostic module that determines an estimated pressure increase within said fuel rail based on said fuel injected into said fuel rail, that compares an actual pressure increase within said fuel rail to said estimated pressure increase, and that indicates when said actual pressure increase is less than said estimated pressure increase.

2. The engine control system of claim 1 wherein said diagnostic module compares said actual pressure increase to said estimated pressure increase when fuel injection from said fuel rail is suspended.

3. The engine control system of claim 1 wherein said diagnostic module controls said fuel pump control module to inject a predetermined amount of fuel when fuel injection from said fuel rail is suspended.

4. The engine control system of claim 1 wherein said diagnostic module calculates a compensation factor based on said comparison.

5. The engine control system of claim 4 wherein said diagnostic module indicates when said compensation factor is greater than or equal to a predetermined threshold.

6. The engine control system of claim 4 further comprising a compensation module that generates a compensated pressure signal based on said compensation factor and a desired pressure, and wherein said fuel pump control module controls said pump to inject fuel based on said compensated pressure signal.

7. The engine control system of claim 4 wherein said diagnostic module suspends calculating said compensation factor when said actual pressure increase is greater than or equal to said estimated pressure increase.

8. An engine control method comprising:

controlling a pump to inject fuel into a fuel rail;

determining an estimated pressure increase within said fuel rail based on said fuel injected into said fuel rail;

comparing an actual pressure increase within said fuel rail to said estimated pressure increase; and indicating when said actual pressure increase is less than said estimated pressure increase.

9. The engine control method of claim 8 further comprising:

comparing said actual pressure increase to said estimated pressure increase when fuel injection from said fuel rail is suspended.

10. The engine control method of claim 8 further comprising:

injecting a predetermined amount of fuel when fuel injection from said fuel rail is suspended.

11. The engine control method of claim 8 further comprising:

calculating a compensation factor based on said comparison.

12. The engine control method of claim 11 further comprising:

indicating when said compensation factor is greater than or equal to a predetermined threshold.

13. The engine control method of claim 11 further comprising:

generating a compensated pressure signal based on said compensation factor and a desired pressure; and controlling said pump to inject fuel based on said compensated pressure signal.

14. The engine control method of claim 11 further comprising:

suspending calculation of said compensation factor when said actual pressure increase is greater than or equal to said estimated pressure increase.

* * * * *